US005630345A

United States Patent [19]

Ciccotelli

[11] Patent Number: 5,630,345

[45] Date of Patent: May 20, 1997

[54] PLIERS HAVING A MANUALLY ADJUSTABLE, SELF-LOCKING HINGED JAW PIECE

[76] Inventor: Stephen S. Ciccotelli, P.O. Box 1414, Deming, N.M. 88031

[21] Appl. No.: 329,606

[22] Filed: Oct. 26, 1994

[51] Int. Cl.[6] ..... B25B 7/12

[52] U.S. Cl. ..... 81/373; 81/424

[58] Field of Search ..... 81/352, 373, 389, 81/390, 403, 424

[56] References Cited

U.S. PATENT DOCUMENTS

| | | | |
|---|---|---|---|
| 2,341,489 | 2/1944 | Tornborg | 81/424 X |
| 2,478,696 | 8/1949 | Isele | 81/424 X |
| 2,603,995 | 7/1952 | Sandstrom | 81/424 |
| 2,679,779 | 6/1954 | Spikings | 81/424 X |

*Primary Examiner*—James G. Smith

*Attorney, Agent, or Firm*—Carothers & Carothers

[57] ABSTRACT

The pliers has a hinged jaw piece which is pivotally attached to a support arm for adjusting the hinged jaw piece parallel relative to the other jaw. The adjustment means is manually operated and is self-locking.

4 Claims, 1 Drawing Sheet

PLIERS HAVING A MANUALLY ADJUSTABLE, SELF-LOCKING HINGED JAW PIECE

BACKGROUND OF THE INVENTION

A problem that substantially reduces the usefulness of the conventional pliers is that jaws are not parallel to each other when gripping an object thereby causing the jaws to have the tendency to slip off the object.

SUMMARY OF THE INVENTION

It is an object of this invention to provide a pliers having a hinged jaw piece which can be manually adjusted parallel relative to the other jaw and which is self-locking in the adjusted position.

It is another object of this invention to provide a pliers of the character described in which the jaws are adapted to be inserted in tight quarters.

Further objects and advantages of the invention will appear as the specification proceeds.

The preferred form of my invention adapted to a locking pliers is illustrated in the accompanying drawings in which.

Figure 1:
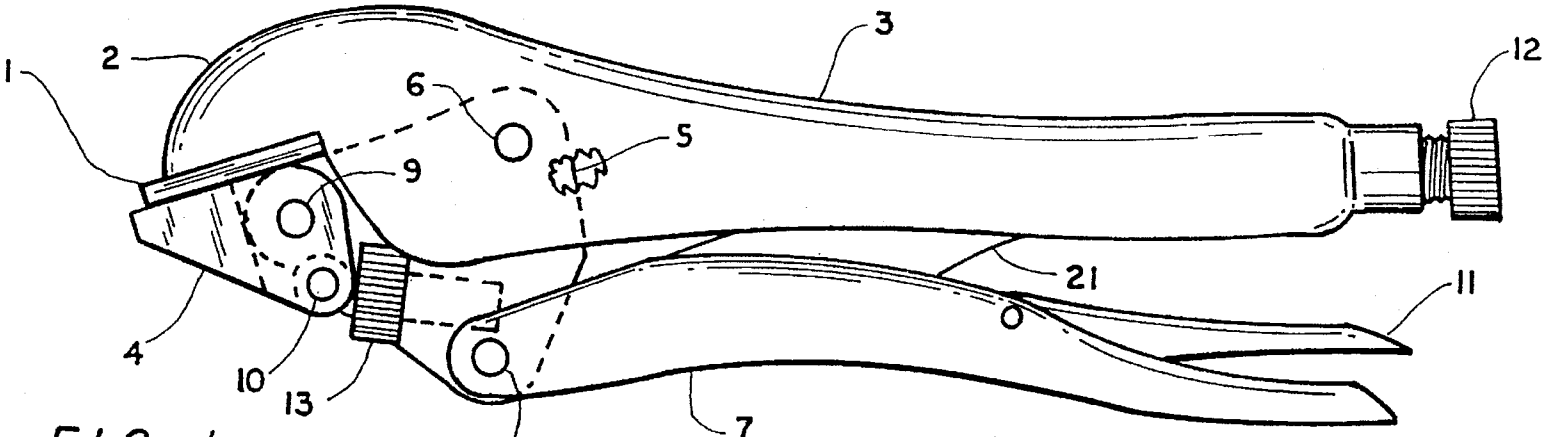
FIG. 1 is a side view of the pliers with the jaws being shown in the closed position.

While I have shown only the preferred form of my invention, I wish to have it understood that various changes and modifications may be made within the scope of the claims hereto attached without departing from the spirit of the invention.

DESCRIPTION OF THE PREFERRED EMBODIMENTS

Referring to the drawings in detail, the pliers comprise: a fixed jaw 1, a support arm 2 for the fixed jaw 1, a handle 3 attached to the support arm 2, a hinged jaw piece 4, a support arm 5 for the hinged jaw piece 4, the support arm 5 being pivotally attached to support arm 2 with pin 6, a handle 7 pivotally attached to support arm 5 with pin 8, hinged jaw piece 4 being pivotally attached to support arm 5 with pin 9, a toggle mechanism 21, a release 8 lever 11, a thumb screw 12, and a hinged jaw piece adjustment mechanism 13 which includes a link 14 which is threaded for most of its length and is engaged in adjustment nut 15, the link 14 having a hole in one end and being pivotally attached to hinged jaw piece 4 with pin 10.

The support arm 5 has a long clearance hole 17 to accept part of the threaded portion of link 14, the length of link 14 being long enough that it does not fall out of clearance hole 17 when the jaws of the pliers are in the wide open position.

The support arm 5 has a notch 18 which prevents adjustment nut 15 from moving in an axial direction but does not prevent it from turning. The hinged jaw piece 4 has a face

19 adapted to be clamped on an object, the face 19 preferably having sharp teeth (not shown), a tapered side 20 to permit the hinged jaw piece 4 to be inserted in tight quarters, and two plates 16 spaced apart to form a clevis, the plates 16 being large enough to pivotally attach the hinged jaw piece 4 to support arm 5 with pin 9, and to pivotally attach hinged jaw piece 4 to link 14 with pin 10.

The angular position of hinged jaw piece 4 is adjusted by turning adjustment nut 15. The hinged jaw piece 4 stays in adjusted position regardless of the clamping forces because link 14 is threaded and is engaged in adjustment nut 15 thereby making the adjustment mechanism 13 self-locking.

Figure 2:
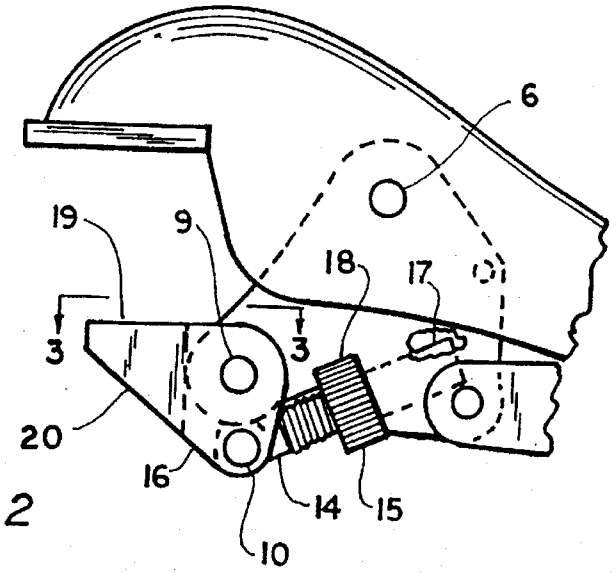
FIG. 2 is a partial side view of the pliers with the jaws being shown in the wide open position.
Figure 3:
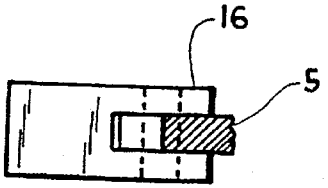
FIG. 3 is a partial sectional view taken at 3—3 of FIG. 2.

An undersireable feature of a pliers having a hinged jaw piece is the fact that when the jaws are in the wide open position, illustrated in FIG. 2, the distance measured from pin 6 to the tip of the hinged jaw piece 4 is substantially less than the distance measured from pin 6 to the tip of the fixed jaw 1.

To partially compensate for this condition, the pliers is designed so that the tip of the hinged jaw piece 4 extends beyond the tip of fixed jaw I when the jaws are in the closed position, illustrated in FIG. 1.

I claim:

1. In a pliers comprising: (a) a fixed jaw; (b) a support arm for the fixed jaw fixedly attached to the fixed jaw; (c) a hinged jaw piece; (d) a support arm for the hinged jaw piece pivotally attached to the hinged jaw piece, the support arm for the hinged jaw piece being pivotally attached to the support arm for the fixed jaw; (e) a handle attached to the support arm for the fixed jaw; (f) a handle attached to the support arm for the hinged jaw piece; and (g) means for adjusting the position of the hinged jaw piece parallel relative to the fixed jaw including means for locking the hinged jaw piece in adjusted position, the adjusting and locking means for the hinged jaw piece including a link pivotally connected to the hinged jaw piece and operatively connected to the support arm for the hinged jaw piece.

2. In the pliers of claim 1 wherein the hinged jaw piece includes: (a) a face adapted to be clamped on an object; (b) a tapered side to permit the hinged jaw piece to be inserted in tight quarters, and (c) at least one plate, the plate being large enough to pivotally connect the plate to both the support arm for the hinged jaw piece and the link.

3. In the pliers of claim 1 wherein the adjusting and locking means include: (a) a hole in one end of the link for pivotally connecting the link to the hinged jaw piece, the link being threaded for most of its length; (b) an adjustment nut adapted to be turned manually, the threaded portion of the link being engaged in the adjustment nut; (c) a clearance hole in the support arm for the hinged jaw piece to accept the threaded portion of the link; and (d) a notch in the support arm for the hinged jaw piece to prevent the adjustment nut from moving in an axial direction.

4. In the pliers of claim 1 wherein the tip of the hinged jaw extends beyond the tip of the fixed jaw when the jaws are in the closed position.

* * * * *

UNITED STATES PATENT AND TRADEMARK OFFICE

CERTIFICATE OF CORRECTION

PATENT NO. : 5,630,345

DATED : May 20, 1997

INVENTOR(S) : Stephen S. Ciccotelli

It is certified that error appears in the above-identified patent and that said Letters Patent is hereby corrected as shown below:

Column 1, line 46, delete "8"

Signed and Sealed this

Sixth Day of January, 1998

*Attest:*

Bruce Lehman

BRUCE LEHMAN

*Attesting Officer*

*Commissioner of Patents and Trademarks*